US007604307B2

(12) United States Patent
Greenwald et al.

(10) Patent No.: US 7,604,307 B2
(45) Date of Patent: Oct. 20, 2009

(54) TELESCOPING SLIDE ASSEMBLY WITH QUICK-MOUNT KEYHOLE LOCK SYSTEM

(75) Inventors: William B. Greenwald, Beech Grove, IN (US); Richard C. Evans, Shelbyville, IN (US)

(73) Assignee: General Devices Co., Inc., Indianapolis, IN (US)

( * ) Notice: Subject to any disclaimer, the term of this patent is extended or adjusted under 35 U.S.C. 154(b) by 1064 days.

(21) Appl. No.: 10/692,839

(22) Filed: Oct. 24, 2003

(65) Prior Publication Data

US 2005/0088069 A1 Apr. 28, 2005

(51) Int. Cl.
*A47B 95/00* (2006.01)

(52) U.S. Cl. ..... 312/333; 312/334.46

(58) Field of Classification Search ..... 312/319.1, 312/333, 334.44, 334.46, 334.47; 211/191–192, 211/103, 187, 207–208, 102
See application file for complete search history.

(56) References Cited

U.S. PATENT DOCUMENTS

| | | | | |
|---|---|---|---|---|
| 516,583 | A | 3/1894 | Adkins | |
| 1,698,252 | A | 1/1929 | Ashe | |
| 2,749,200 | A | 6/1956 | Kuss | |
| 2,809,086 | A | 10/1957 | Fall | |
| 3,133,768 | A * | 5/1964 | Klakovich | 312/323 |
| 3,624,703 | A | 11/1971 | Pavek | |
| 3,650,578 | A | 3/1972 | Del Vecchio et al. | |
| 3,679,274 | A | 7/1972 | Nance | |
| 4,331,369 | A * | 5/1982 | Lazar et al. | 312/334.8 |
| 4,423,914 | A | 1/1984 | Vander Ley | |
| 4,441,772 | A | 4/1984 | Fielding et al. | |
| 4,470,716 | A * | 9/1984 | Welch | 248/221.12 |
| 5,199,777 | A | 4/1993 | Taima et al. | |
| 5,292,198 | A | 3/1994 | Rock et al. | |
| 5,316,389 | A | 5/1994 | Hoffman | |
| 5,405,195 | A | 4/1995 | Hobbs | |
| 5,433,517 | A | 7/1995 | Fleisch | |
| 5,571,256 | A * | 11/1996 | Good et al. | 312/223.1 |
| 5,580,138 | A | 12/1996 | Grabher | |
| 5,620,244 | A | 4/1997 | Yang | |
| 5,632,542 | A | 5/1997 | Krivec | |
| 5,671,988 | A | 9/1997 | O'Neill | |
| 5,683,159 | A | 11/1997 | Johnson | |
| 5,730,514 | A | 3/1998 | Hashemi | |
| 5,823,648 | A | 10/1998 | Domenig | |
| 5,904,412 | A | 5/1999 | Lammens | |

(Continued)

FOREIGN PATENT DOCUMENTS

DE 3347540 A1 7/1985

(Continued)

OTHER PUBLICATIONS

PCT/International Search Report (mailed Jan. 10, 2006), PCT/US04/32922 (4 pages).

(Continued)

*Primary Examiner*—Hanh V Tran
(74) *Attorney, Agent, or Firm*—Barnes & Thornburg LLP

(57) ABSTRACT

A telescoping slide assembly includes interconnected load-carrying, intermediate, and stationary slides. A retainer is used to retain a piece of equipment in a fixed position on the load-carrying slide.

31 Claims, 5 Drawing Sheets

U.S. PATENT DOCUMENTS

| | | | | |
|---|---|---|---|---|
| 6,027,194 | A | 2/2000 | Fleisch | |
| 6,123,314 | A * | 9/2000 | Steele | 248/681 |
| 6,209,979 | B1 | 4/2001 | Fall et al. | |
| 6,373,707 | B1 * | 4/2002 | Hutchins | 312/333 |
| 6,588,866 | B2 * | 7/2003 | Cheng | 312/334.7 |
| 6,601,933 | B1 | 8/2003 | Greenwald | |
| 6,796,625 | B2 * | 9/2004 | Lauchner et al. | 312/334.46 |
| 6,938,967 | B2 * | 9/2005 | Dubon et al. | 312/333 |
| 6,948,691 | B2 * | 9/2005 | Brock et al. | 211/192 |
| 6,962,397 | B2 * | 11/2005 | Dobler et al. | 312/333 |
| 2003/0141791 | A1 | 7/2003 | Dubon et al. | |
| 2005/0206284 | A1 * | 9/2005 | Dubon et al. | 312/333 |

FOREIGN PATENT DOCUMENTS

| | | | |
|---|---|---|---|
| EP | 541306 | * | 5/1993 |

OTHER PUBLICATIONS

PCT Written Opinion of the International Search Authority (mailed Jan. 10, 2006) PCT/US04/32922, (4 pages).

* cited by examiner

TELESCOPING SLIDE ASSEMBLY WITH QUICK-MOUNT KEYHOLE LOCK SYSTEM

BACKGROUND

The present disclosure relates to telescoping slide assemblies, and particularly to a slide assembly having at least two telescoping slide members. More particularly, the present invention relates to a pair of spaced-apart telescoping slide assemblies which are adapted to be releasably coupled to a piece of equipment, known as a chassis, which is positioned to lie therebetween.

SUMMARY

According to the present disclosure, a telescoping slide assembly comprises interconnected load-carrying, intermediate, and stationary slides movable relative to one another to extend and retract the load-carrying and intermediate slides relative to the stationary slide between fully extended and retracted positions. The load-carrying slide is formed to include a keyhole-shaped slot adapted to receive a mounting post coupled to a piece of equipment to be carried on the load-carrying slide.

A retainer is coupled to the load-carrying slide and formed to include a retention aperture adapted to receive the mounting post therein. The retainer is used to trap the mounting post to couple a chassis carrying the mounting post to the load-carrying slide.

When moved to a slot-closing position, the retainer is arranged to allow a mounting post extending through a narrow-width post-retainer portion of the keyhole-shaped slot to extend into the retention aperture formed in the retainer so that the chassis carrying the mounting post is coupled to the load-carrying slide. The mounting post is retained in the retention aperture formed in the retainer until the retainer is moved by a technician to release the mounting post.

When moved to a slot-opening position, the retainer is arranged to "release" the mounting post from the retention aperture formed in the retainer to allow the mounting post to be moved in the keyhole-shaped slot by a technician to an enlarged-diameter entry/exit portion of the slot. At this stage, the technician may remove the mounting post from the slot to cause the chassis carrying the mounting post to be decoupled from the load-carrying slide.

Features of the present disclosure will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which:

FIG. 6*a* is a perspective view of two load-carrying slides after they have been separated from their companion intermediate slides and before they are coupled to the mounting posts provided on the piece of equipment to be supported by the load-carrying slides;

FIG. 6*b* is a view similar to FIG. 6*a* showing movement of a unit comprising the two load-carrying slides and the piece of equipment therebetween toward the two intermediate slides before the two load-carrying slides are mated with the two intermediate slides;

FIG. 7 shows alignment of a keyhole-shaped slot formed in a load-carrying slide with a mounting post on a chassis;

FIG. 8 shows admission of the mounting post into an enlarged-diameter entry/exit portion of the keyhole-shaped slot and is a sectional view taken along line 8-8 of FIG. 8*a;*

FIG. 9 shows initial movement of the mounting post into a narrow-width post-retainer portion of the keyhole-shaped slot and is a sectional view taken along line 9-9 of FIG. 9*a;*

FIG. 10 shows complete movement of the mounting post into the narrow-width post-retainer portion of the keyhole-shaped slot and into a retention aperture formed in the post retainer to limit discharge of the mounting post from the keyhole-shaped slot;

DETAILED DESCRIPTION OF THE DRAWINGS

Figure 1:
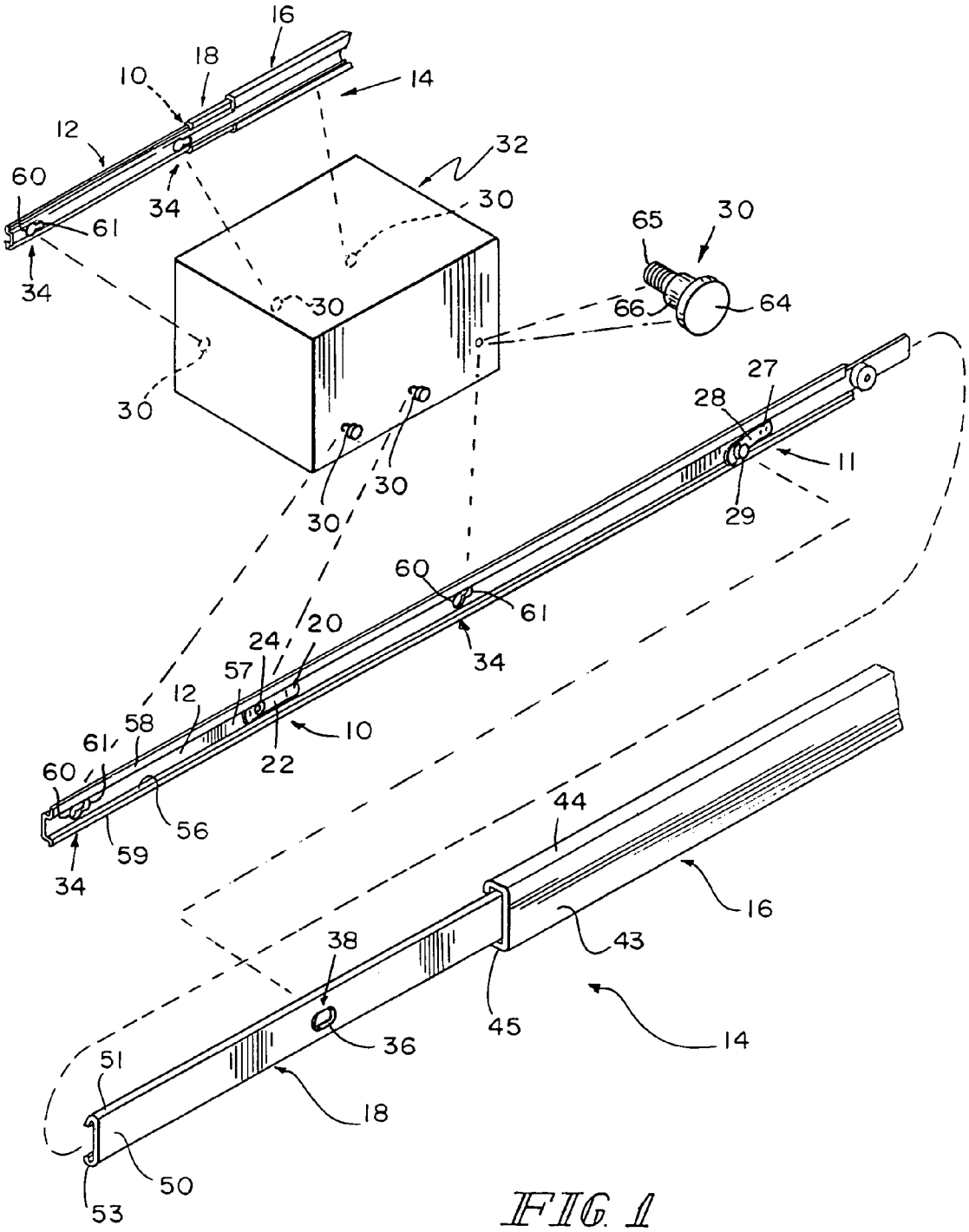
FIG. 1 is a perspective assembly view showing a piece of equipment, known as a "chassis" outfitted with six mounting posts and showing formation of two "keyhole-shaped" post-receiving slots in the chassis-support load-carrying slides of two three-part telescoping slide assemblies and also showing a post retainer adapted to be mounted on a load-carrying slide adjacent to one of the keyhole-shaped post-receiving slots, the post retainer having an arm configured to operate automatically to lock one mounting post in position in each of the telescoping slide assembles (as shown for example, in FIGS. 10 and 10*a*)

A post retainer 10 and a slide retainer 11 are coupled to a load-carrying slide 12 included in a telescoping slide assembly 14. Telescoping slide assembly 14 comprises a stationary slide 16, an intermediate slide 18, and load-carrying slide 12 as suggested in FIGS. 1, 5, 6*b*, and 11.

Figure 5:
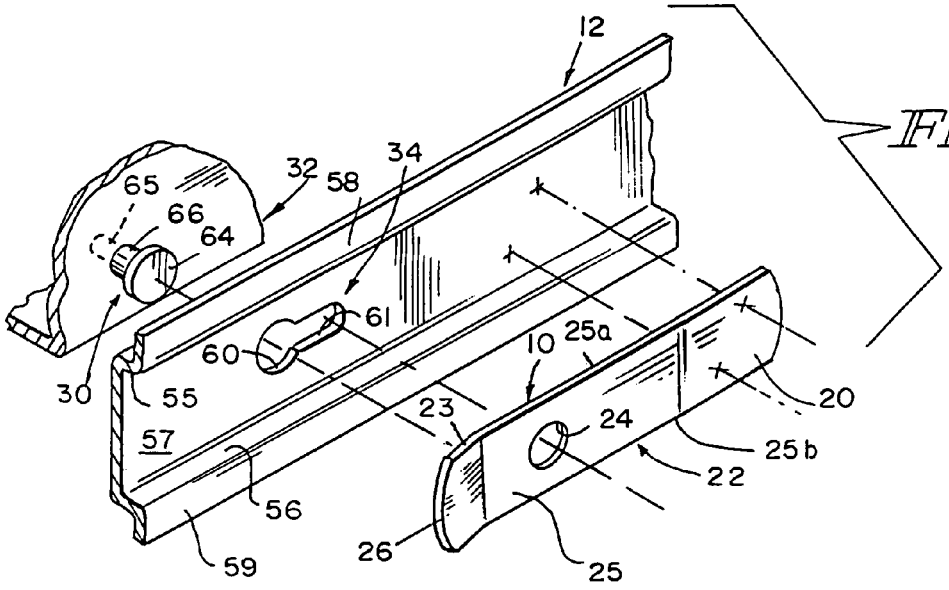
FIG. 5 is an enlarged perspective view of some of the components illustrated in FIG. 4 showing (from left to right) a portion of the chassis, a mounting post on the chassis, a portion of the load-carrying slide formed to include a keyhole-shaped slot sized to receive the mounting post therein, and a post retainer adapted to be coupled to the load-carrying slide, and showing that the keyhole-shaped slot is defined by, for example, an enlarged-diameter entry/exit portion (on the left) and a narrow-width post-retainer portion (on the right)

Post retainer 10 functions as shown, for example, in FIGS. 7-10 to regulate entry and exit of a mounting post 30 on a chassis 32 relative to a post-receiving slot 34 formed in load-carrying slide 12. Slot 34 is "keyhole-shaped" in the illustrated embodiment. Post retainer 10 includes, for example, a base 20 adapted to be coupled to load-carrying slide 12 and a movable arm 22 cantilevered to base 20 and formed to include a retention aperture 24 as shown in FIG. 5.

Figure 3:
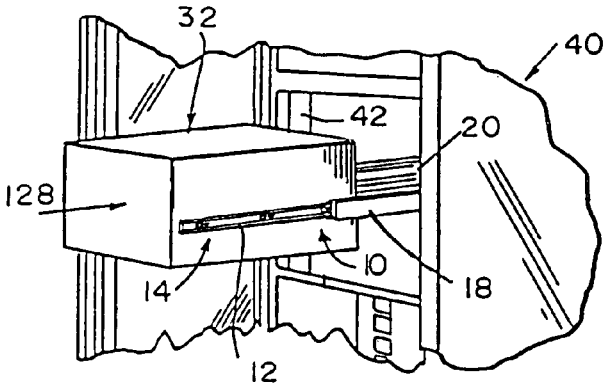
FIG. 3 is a perspective view similar to FIG. 2 showing the chassis mounted on the slide assemblies just before the chassis is pushed inwardly (in the direction of the arrow) into a stored position within the cabinet.
Figure 11:
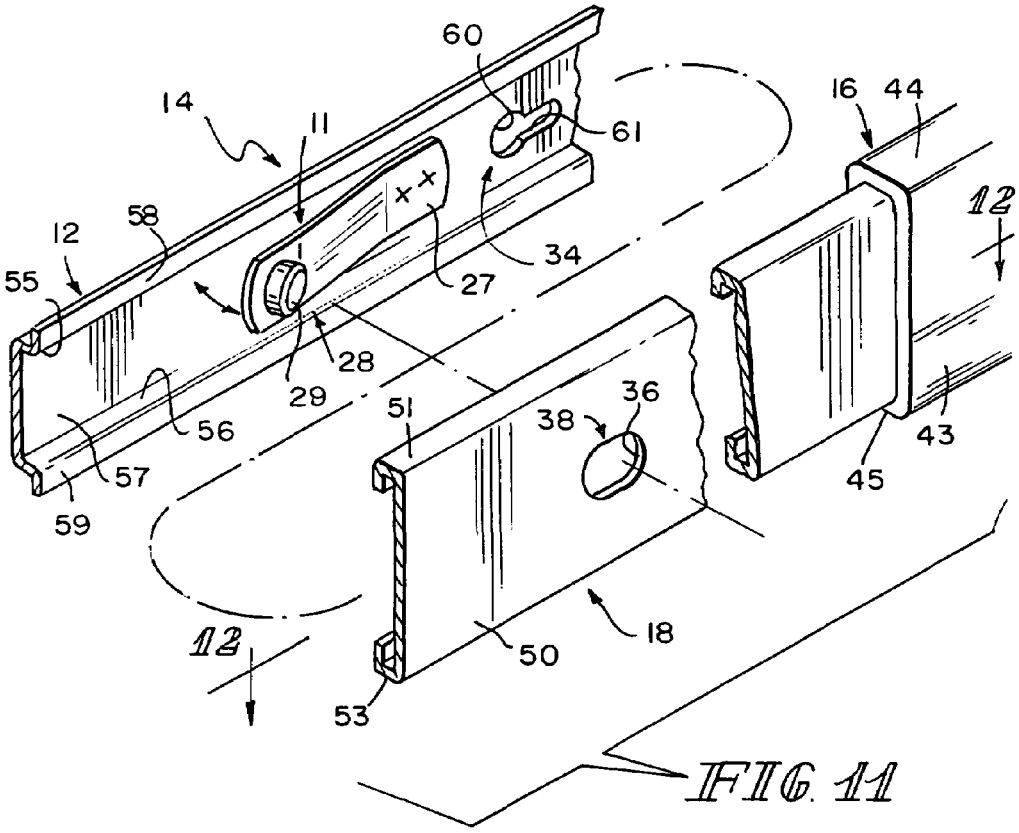
FIG. 11 is an enlarged perspective view of a slide retainer coupled to the load-carrying slide and configured to extend into an aperture formed in the intermediate slide member during sliding movement of the load-carrying slide relative to the intermediate slide.
Figure 12:
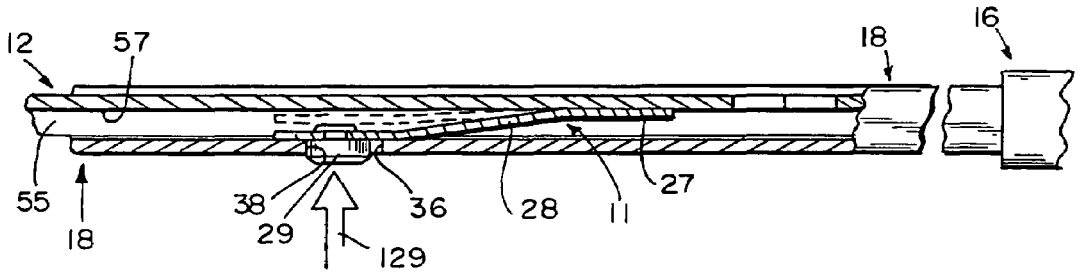
FIG. 12 is a sectional view taken along line 12-12 of FIG. 1 after assembly of the components shown in FIG. 11 showing placement of a button included in the slide retainer in the "button-retention" aperture formed in the intermediate slide member to retain the load-carrying slide member in an extended position relative to the intermediate slide member (see, for example, FIG. 2) and suggesting that inward movement of the button to disengage that aperture will "release" the load-carrying slide member for sliding movement relative to the intermediate slide member.

Slide retainer 11 functions as suggested, for example, in FIGS. 11 and 12 to engage a retraction stop 36 formed on intermediate slide 18 at, for example, button-retention aperture 38 to block movement of load-carrying slide 12 relative to intermediate slide 18 in rearward direction 128 from a fully extended position toward a retracted position as suggested, for example, in FIG. 3. Slide retainer 11 includes, for example, a base 27 coupled to load-carrying slide 12 and a movable arm 28 cantilevered to base 27 and configured to carry a button 29 sized to extend into button-retention aperture 38.

Figure 2:
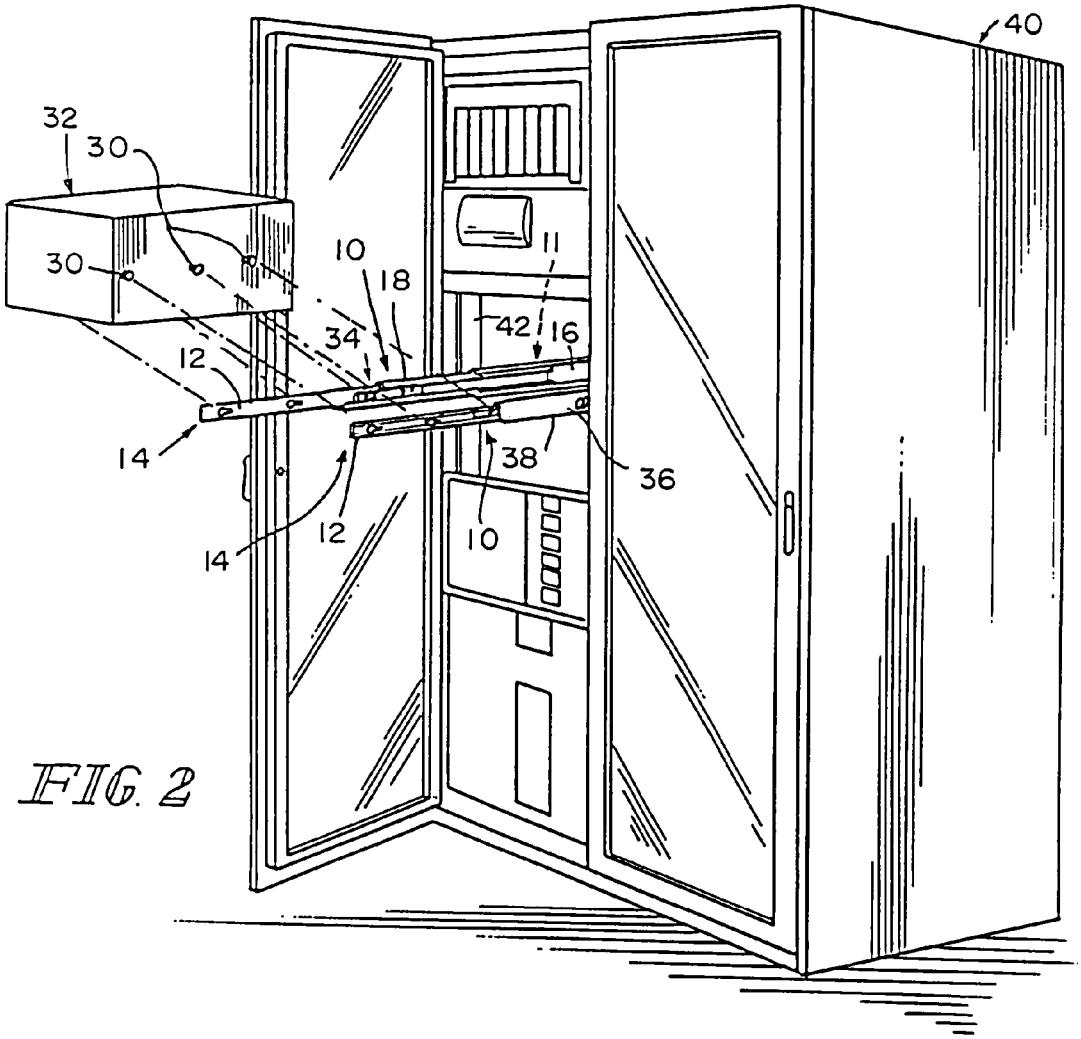
FIG. 2 is a perspective view of the chassis (e.g., a server) shown in FIG. 1 before the chassis is mounted onto two fully extended telescoping slide assemblies fixed in a cabinet.

Mounting posts 30 are coupled to chassis 32 and adapted to be coupled to load-carrying slides 12 included in the pair of telescoping slide assemblies 14 mounted to lie in spaced-apart parallel relation to one another in a cabinet 40 as shown, for example, in FIGS. 1-3 to permit a user to mount and dismount chassis 32 quickly and easily. In one embodiment, chassis 32 is a server and cabinet 40 is a server cabinet.

Cabinet 40 includes, for example, a rack of computer equipment and chassis 32 is sized to be mounted on telescoping slide assemblies 14 to permit technicians to gain access to chassis 32 by moving it out of cabinet 40 on telescoping slide assemblies 14. Installation and replacement of such a chassis is quick and easy because of the way in which mounting posts 30 are released from positions in post-receiving slides 12. Reference is made to U.S. Pat. No. 6,209,979 and to U.S. patent application Ser. No. 10/177,552, which are hereby incorporated in their entirety by reference herein, for descriptions of chassis mounting post retention and release systems.

Figure 4:
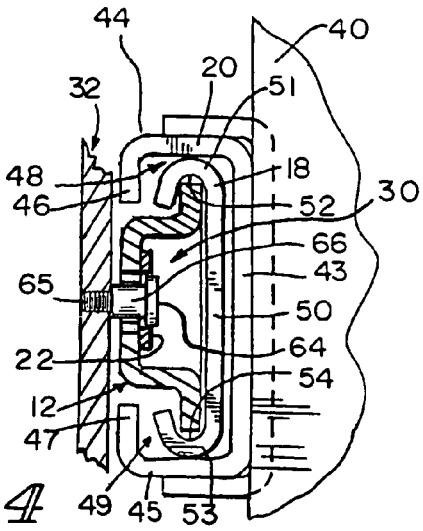
FIG. 4 is a sectional view taken along line 4-4 of FIG. 3 showing the position of one of the mounting posts coupled to the chassis and received within one of the keyhole-shaped slots formed in the load-carrying slide of the three-part telescoping slide assembly.
Figure 6A:
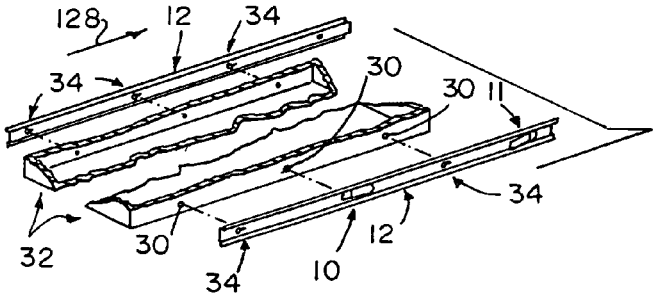
FIGS. 6*a* and 6*b* show one illustrative manner of mounting a chassis on the two telescoping slide assemblies.
Figure 6B:
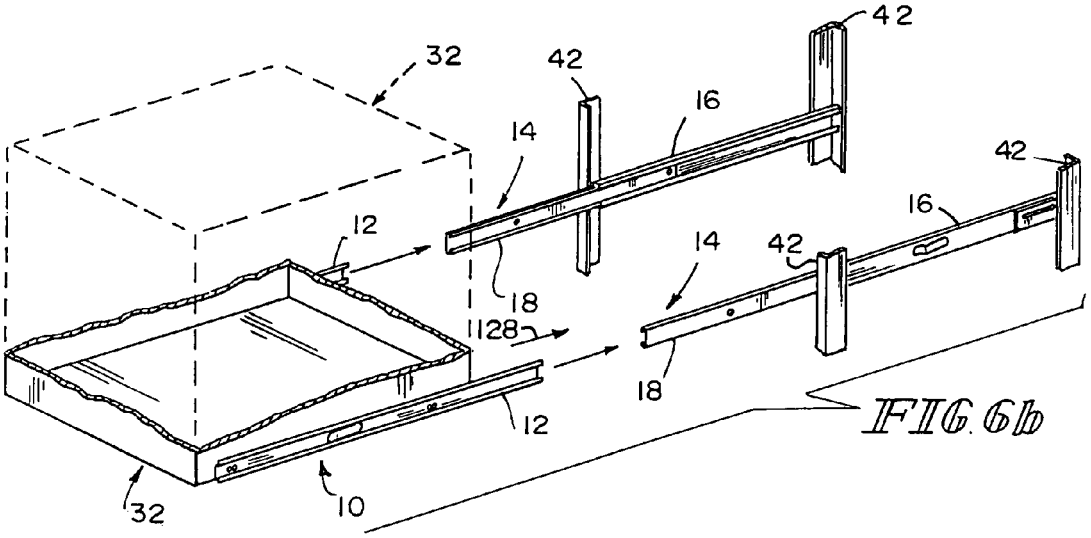

Each telescoping slide assembly 14 is fixed to cabinet 40 and movable between a fully retracted position and a fully extended position relative to cabinet 40 so that chassis 32 may be stored within cabinet 40 as suggested by FIGS. 3 and 6*b*. Stationary slide 16 is fixed to vertical rails 42 using any suitable brackets (not shown). As shown in FIGS. 1 and 4, a stationary slide 20 includes a vertical wall 43, a top wall 44, a bottom wall 45, and first and second rims 46, 47. An upper channel 48 is formed by top wall 44 and first rim 46 and a lower channel 49 is formed by bottom wall 45 and second rim 47.

Intermediate slide 18 includes a vertical wall 50, a top wall 51 formed to define upper channel 52, and a bottom wall 53 formed to define lower channel 54 as shown, for example, in FIG. 4. Intermediate slide 18 is received within stationary slide 16 as shown, for example, in FIGS. 1 and 4 for sliding movement therein.

Load-carrying slide 12 includes a pair of horizontally extending flanges 55, 56 and a generally flat vertically extending wall 57 located between the pair of horizontally extending flanges 55, 56. The generally flat vertically extending wall 57 defining a plane. A vertically extending upper lip 58 is coupled to flange 55 and a vertically extending lower lip 59 is coupled to flange 56.

Each post-receiving slot 34 formed in load-carrying slide 12 includes an entry/exit portion 60 and a post-retainer portion 61 as shown best in FIG. 5. In the illustrated embodiment, each post-receiving slot 34 is formed to have a keyhole shape and is adapted to receive one of mounting posts 30 therein. Each mounting post 30 includes a head 64 at one end, an anchor 65 at an opposite end, and a throat 66 positioned to lie between head 64 and anchor 65, as shown, for example, in FIGS. 1 and 4.

Referring to FIGS. 1, 2, 3, 5, 6*a*, 6*b*, and 7-10, it is apparent how easy it is for a technician to position chassis 32 between two load-carrying slides 12 that have been separated from their companion intermediate slides (as suggested in FIG. 6*a*). During this effort, chassis 32 is moved so that mounting posts 30 extend into keyhole-shaped post-receiving slots 34 formed in load-carrying slides 12 included in each of the telescoping slide assemblies 14. Chassis 32 is moved in a rearward direction 128 to cause post retainers 10 mounted on each of load-carrying sides 12 to "lock" chassis 32 to load-carrying slides 12 without the need to use any tools. Throat 66 of mounting post 30 is sized to move easily into and out of entry/exit portion 60 of post-receiving slot 34, while head 64 has a diameter that is greater than the narrow width of the post-receiver portion 61 of post-receiving slot 34. Release of mounting posts 30 from their retained positions in post-receiving slots 34 to permit removal of chassis 32 from a mounted position on telescoping slide assemblies 14 is just as easy.

Chassis 32 could be installed on telescoping slide assemblies 14 in a variety of different ways. Using one technique that is within the scope of this disclosure, chassis 32 is bench-assembled with load-carrying slides 12 after those slides 12 have been separated from their companion intermediate slides 18 as suggested, for example, in FIG. 6*a*. Then the load-carrying slides 12 mounted on chassis 32 are mated with their companion intermediate slides 18 as suggested, for example, in FIG. 6*b*. This process will allow quick mounting with no bowing of the slides.

As suggested in FIG. 5, load-carrying slide 12 is formed to include a keyhole-shaped slot 34 providing an enlarged-diameter entry/exit portion 60 and a narrow-width post-retainer portion 61. Keyhole-shaped slot 34 is adapted to receive mounting post 30 coupled to a piece of equipment 32 to be carried on load-carrying slide 12 as suggested in FIGS. 7-10. Entry/exit portion 60 has a diameter greater than head 64 and throat 66 to allow mounting post 30 to pass freely through entry/exit portion 60 as suggested in FIG. 8*a*. Post-retainer portion 61 has a width selected to allow reciprocable movement of throat 66 therein but block movement of head 64 therethrough as suggested in FIG. 10*a*.

Post retainer 10 includes a base 20 coupled to load-carrying slide 12 and an arm 22 formed to include a retention aperture 24 as also suggested in FIG. 5. Retention aperture 24 has a diameter greater than head 64 and throat 66 of mounting post 30. Arm 22 is coupled to base 20 to move relative to load-carrying slide 12 between a slot-opening position (shown in FIG. 8) lying away from load-carrying slide 12 to allow movement of mounting post 30 into enlarged diameter entry/exit portion 60 of keyhole-shaped slot 34 and a slot-closing position (shown in FIG. 10) receiving mounting post 30 in retention aperture 24 upon movement of mounting post 30 from enlarged-diameter entry/exit portion 60 into narrow-width post-retainer portion 61 of keyhole-shaped slot 34.

Figure 10:
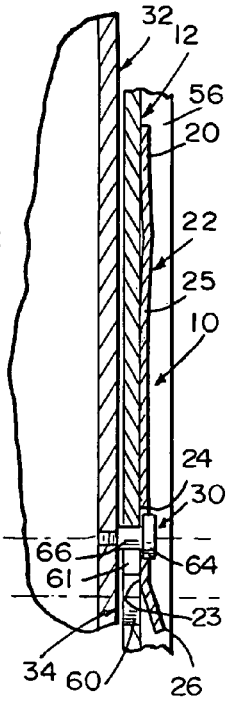
Figure 10A:
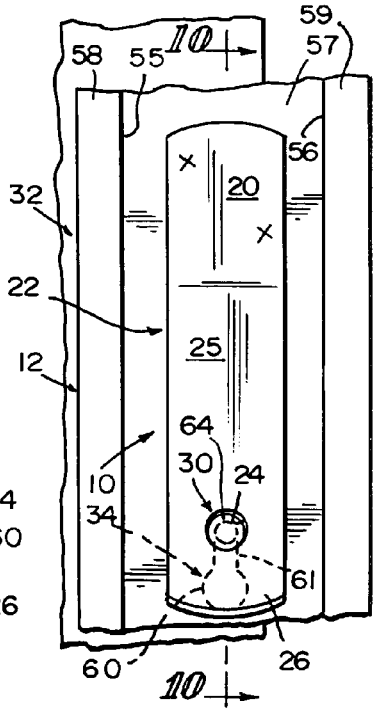

Arm 22 of post retainer 10 includes an actuator 23 and a body 25 arranged to interconnect actuator 23 and base 20. Body 25 is formed to include retention aperture 24. Actuator 23 is arranged to overlie at least a portion of enlarged-diameter entry portion 60 of keyhole-shaped slot 34 to intercept a mounting post 30 moved there through when the post retainer 10 is moved to assume the slot-closing position as shown in FIGS. 10 and 10*a*. As suggested, for example, in FIGS. 8 and 9, actuator 23 includes means, facing toward enlarged-diameter entry/exit portion 60 of keyhole-shaped slot 34, for intercepting a mounting post 30 moving into enlarged-diameter entry/exit portion 60 and bending body 25 to cause body 25 to move away from load-carrying slide 12 so that mounting post 30 can pass from enlarged-diameter entry/exit portion 60 of keyhole-shaped slot 34 into narrow-width post-retainer portion 61 of keyhole-shaped slot 34 and head 64 of mounting post 30 can pass into retention aperture 24 formed in body 25 whereupon actuator 23 moves toward load-carrying slide 12 under a restoring force applied by body 25 to block removal of throat 66 of mounting post 30 from narrow-width post-retainer portion 61 and head 64 of mounting post 30 from retention aperture 24 as suggested in FIGS. 10 and 10*a*.

Figure 7:
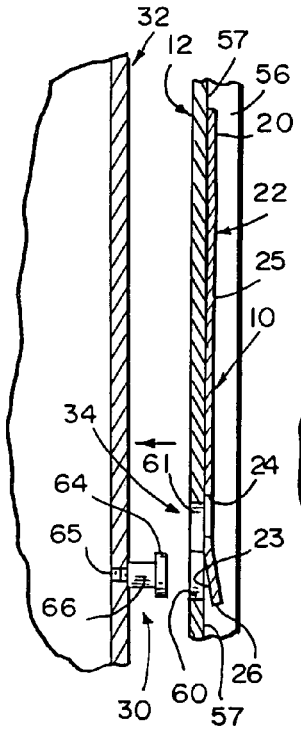
FIGS. 7-10 are sectional view showing a sequence of steps illustrating on a chassis into a keyhole-shaped slot formed in a load-carrying slide and use of a post retainer to limit discharge of the mounting post from the keyhole-shaped slot.
Figure 8:
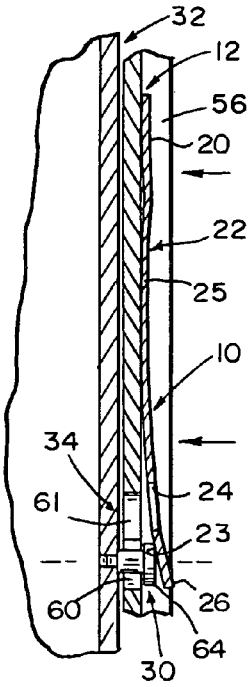
Figure 9:
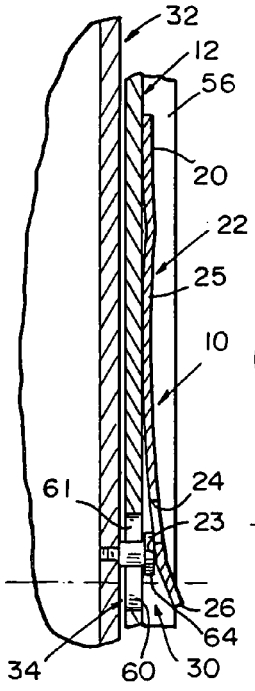

Arm 22 further includes a lift tab 26 arranged to lie at an angle relative to body 25 and to load-carrying slide 12 as suggested in FIGS. 5 and 7. Lift tab 26 provides means for allowing a user to grip post retainer 10 and move actuator 23 away from load-carrying slide 12 to bend body 25 to release head 64 of mounting post 30 from retention aperture 24 so that throat 66 of mounting post 30 is free to move from narrow-width post-retainer portion 61 of keyhole-shaped slot 34 into enlarged-diameter entry/exit portion 60 of keyhole-shaped slot 34 in preparation for removal of mounting post 30 from keyhole-shaped slot 34.

Figure 8A:
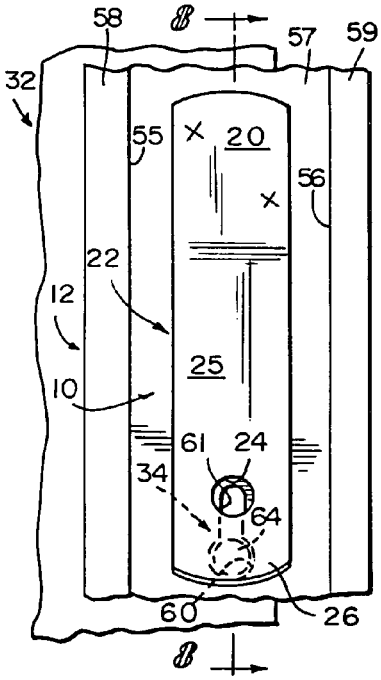
Figure 9A:
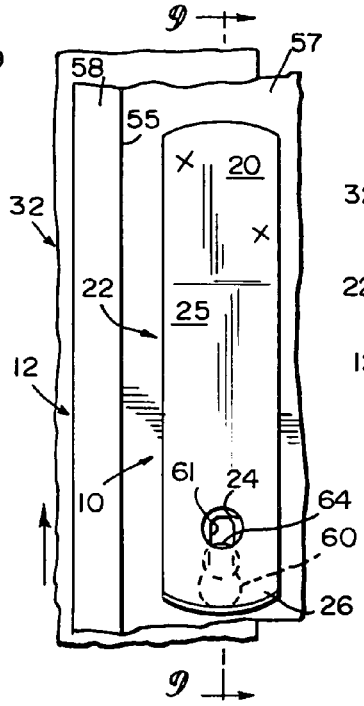

Body 25 of arm 22 is wider than narrow-width post-retainer portion 61 of keyhole-shaped slot 34, as shown, for example, in FIG. 8*a*. A portion of body 25 lies adjacent to vertically extending wall 57 to block movement of mounting post 30 from narrow-width post-retainer portion 61 into enlarged-diameter entry/exit portion 60 upon movement of retainer 10 to the slot-closing position as suggested in FIGS. 10 and 10*a*.

A single piece of spring metal is formed to define base 120, body 25, actuator 23, and lift tab 26 of post retainer 10 in an illustrative embodiment. Base 25 is welded to vertically extending wall 57. Side edges 25*a*, 25*b* of body 25 are arranged to lie in spaced-apart relation to horizontally extending upper and lower flanges 58, 59. Body 25 is arranged to cause a portion of body 25 to cover a portion of narrow-width post-retainer portion 61 of keyhole-shaped slot 34 and to cause retention aperture 24 to lie in alignment with narrow-width post-retainer portion 61 of keyhole-shaped slot 34 to allow throat 66 of mounting post 30 to extend through narrow-width post-retainer portion 61 and head 64 of mounting post 30 to extend through retention aperture 24.

Body 25 is formed to include retention aperture 24 and is arranged to lie between base 20 and the lift tab 26. Body 25 is arranged to lie adjacent to vertically extending wall 57 upon movement of the post retainer 10 to the slot-closing position. Lift tab 26 is arranged to lie at an acute angle relative to vertically extending wall 57 included in load-carrying slide 12 as suggested in FIG. 7. Lift tab 26 is coupled to actuator 23 and arranged to extend at an angle relative to base 20 in a direction toward intermediate slide 18 upon movement of the load-carrying and intermediate slides 12, 18 to a retracted position within stationary slide 16 as suggested in FIG. 1.

As suggested in FIGS. 11 and 12, slide retainer 11 includes a base 27 coupled to vertically extending wall 57 of load-carrying slide 12. Slide retainer 11 also includes a movable arm 28 cantilevered to base 27 and a button 29 appended to a distal portion of movable arm 28. Button 29 is sized to fit into button-retention aperture 38 formed in intermediate slide 18. Button 29 is also arranged to extend into button-retention aperture 38 during movement of load-carrying slide 12 relative to intermediate slide 18 toward an extended position under a spring force generated by arm 28. In an illustrative embodiment, base 27 and movable arm 28 are made of a single piece of spring steel.

When load-carrying slide 12 is fully extended with respect to intermediate slide 18 as suggested in FIG. 12, then button 29 extends into button-retention aperture 29. In such a position, button 29 is arranged to engage a retraction stop 36 on intermediate slide 18 bordering button-retention aperture 38 to block movement of load-carrying slide 12 relative to intermediate slide 18 toward a retracted position. A technician can move button 29 in direction 129 against the spring force generated by arm 28 to assume the phantom position shown in FIG. 12 to "release" load-carrying slide 12 to move relative to intermediate slide 18 toward a retracted position.

The invention claimed is:

1. A telescoping slide assembly comprising interconnected load-carrying, intermediate, and stationary slides movable relative to one another to extend and retract the load-carrying and intermediate slides relative to the stationary slide, the load-carrying slide being formed to include a keyhole-shaped slot providing an enlarged-diameter entry and exit portion and a narrow-width post-retainer portion, the keyhole-shaped slot being adapted to receive a mounting post coupled to a piece of equipment to be carried on the load-carrying slide, and a post retainer including a base coupled to the load-carrying slide and an arm formed to include a retention aperture and being coupled to the base to move relative to the load-carrying slide between a slot-opening position lying away from the load-carrying slide to allow movement of the mounting post into the enlarged-diameter entry and exit portion of the keyhole-shaped slot and a slot-closing position receiving the mounting post in the retention aperture upon movement of the mounting post from the enlarged-diameter entry and exit portion into the narrow-width post-retainer portion of the keyhole-shaped slot.

2. The assembly of claim 1, wherein the arm includes an actuator and a body arranged to interconnect the actuator and the base, the body is formed to include the retention aperture, and the actuator includes means, facing toward the enlarged-diameter entry and exit portion of the keyhole-shaped slot, for intercepting a mounting post moving into the enlarged-diameter entry and exit portion and bending the body to cause the body to move away from the load-carrying slide so that the mounting post can pass from the enlarged-diameter entry and exit portion of the keyhole-shaped slot into the narrow-width post-retainer portion of the keyhole-shaped slot and the retention aperture formed in the body whereupon the actuator moves toward the load-carrying slide under a restoring force applied by the body to block removal of the mounting post from narrow-width post-retainer portion and the retention aperture.

3. The assembly of claim 2, wherein the arm further includes a lift tab arranged to lie at an angle relative to the body and to the load-carrying slide to provide means for allowing a user to grip the retainer and move the actuator away from the load-carrying slide to bend the body to release the mounting post from the retention aperture so that the mounting post is free to move from the narrow-width post-retainer portion of the keyhole-shaped slot into the enlarged-diameter entry and exit portion of the keyhole-shaped slot in preparation for removal of the mounting post from the keyhole-shaped slot.

4. The assembly of claim 2, wherein the load-carrying slide includes a vertically extending upper lip, a horizontally extending upper flange coupled to the vertically extending upper lip, a vertically extending lower lip, a horizontally extending lower flange coupled to the vertically extending lower lip, and a vertically extending wall interconnecting the horizontally extending upper and lower flanges, and the vertically extending wall is formed to include the keyhole-shaped slot and is coupled to the base.

5. The assembly of claim 4, wherein the body of the arm is wider than the narrow-width post-retainer portion of the keyhole-shaped slot and a portion of the body lies adjacent to the vertically extending wall to block movement of the mounting post from the narrow-width post-retainer portion into the enlarged-diameter entry and exit portion upon movement of the retainer to the slot-closing position.

6. The assembly of claim 4, wherein a single piece of spring metal is formed to define the base and body of the retainer, the base is welded to the vertically extending wall, side edges of the body are arranged to lie in spaced-apart relation to the horizontally extending upper and lower flanges, and the body is arranged to cause a portion of the body to cover a portion of the narrow-width post-retainer portion of the keyhole-shaped slot and to cause the retention aperture to lie in alignment with the narrow-width post-retainer portion of the keyhole-shaped slot to allow the mounting post to extend through the narrow-width post-retainer portion and the retention aperture.

7. The assembly of claim 1, wherein a single piece of spring metal is formed to define the post retainer and the post retainer is arranged to lie between the load-carrying and intermediate slides upon movement of the load-carrying and intermediate slides to a retracted position in the stationary slide.

8. The assembly of claim 7, wherein the arm includes a distal end formed to include a lift tab arranged to lie at an acute angle relative to a vertically extending wall included in the load-carrying slide and formed to include the keyhole-shaped slot.

9. The assembly of claim 8, wherein the arm includes a body formed to include the retention aperture and arranged to lie between the base and the lift tab and the body is arranged to lie adjacent to the vertically extending wall upon movement of the post retainer to the slot-closing position.

10. The assembly of claim 8, wherein the arm includes a body formed to include the retention aperture and arranged to lie between the base and the lift tab and the body is bendable to cause a portion thereof formed to include the retention aperture to move away from the vertically extending wall upon movement of the post retainer to the slot-opening position.

11. The assembly of claim 7, wherein the arm includes an actuator arranged to overlie at least a portion of the enlarged-diameter entry portion of the keyhole-shaped slot to intercept a mounting post moved therethrough when the post retainer is moved to assume the slot-closing position.

12. The assembly of claim 11, wherein the arm further includes a body made of a spring metal and formed to include the retention aperture and arranged to lie between the base and the actuator.

13. The assembly of claim 11, wherein the arm further includes a lift tab coupled to the actuator and arranged to extend at an angle relative to the base in a direction toward the intermediate slide upon movement of the load-carrying and intermediate slides to a retracted position within the stationary slide.

14. The assembly of claim 1, wherein the arm includes an actuator arranged to overlie at least a portion of the enlarged-diameter entry and exit portion of the keyhole-shaped slot to intercept a mounting post moved therethrough when the post retainer is moved to assume the slot-closing position.

15. The assembly of claim 14, wherein the arm further includes a bendable body made of a spring metal and the bendable body is arranged to interconnect the base and the actuator and configured to bend during movement of the post retainer from the slot-closing position to the slot-opening position in response to a force applied by the mounting post to the actuator.

16. The assembly of claim 15, wherein the body is formed to include the retention aperture.

17. The assembly of claim 14, wherein the arm further includes a lift tab coupled to the actuator and arranged to extend at an angle relative to the base in a direction toward the intermediate slide upon movement of the load-carrying and intermediate slides to a retracted position within the stationary slide.

18. A telescoping slide assembly comprising interconnected load-carrying, intermediate, and stationary slides movable relative to one another to extend and retract the load-carrying and intermediate slides relative to the stationary slide, the load-carrying slide having a generally flat wall and being formed to include a slot surrounded in the plane of the wall by the generally flat wall, and a post retainer coupled to the load-carrying slide and formed to include a retention aperture adapted to receive a mounting post coupled to a piece of equipment to be carried on the load-carrying slide and arranged to extend through the slot formed in the load-carrying slide, the post retainer being movable relative to the load-carrying slide between a slot-closing position adapted to retain at the same time the mounting post in the slot and the retention aperture and a slot-opening position adapted to release the mounting post from the slot and the retention aperture.

19. The assembly of claim 18, wherein the retainer is a strip of spring metal including a base fixed to the load-carrying slide and a body cantilevered to the base and formed to include the retention aperture.

20. A telescoping slide assembly comprising interconnected load-carrying, intermediate, and stationary slides movable relative to one another to extend and retract the load-carrying and intermediate slides relative to the stationary slide, the load-carrying slide being formed to include a slot, a post retainer coupled to the load-carrying slide and formed to include a retention aperture adapted to receive a mounting post coupled to a piece of equipment to be carried on the load-carrying slide and arranged to extend through the slot formed in the load-carrying slide, the post retainer being movable relative to the load-carrying slide between a slot-closing position adapted to retain at the same time the mounting post in the slot and the retention aperture and a slot-opening position adapted to release the mounting post from the slot and the retention aperture, and wherein the post retainer further includes a distal end formed to include a lift tab arranged to extend at an angle relative to the base in a direction toward the intermediate slide upon movement of the load-carrying and intermediate slides to a retracted position within the stationary slide.

21. The assembly of claim 20, wherein the post retainer further includes an actuator arranged to interconnect the body and the lift tab and configured to provide means for intercepting a mounting post moving into an entry and exit portion of the slot to move the body relative to the load-carrying slide so that the mounting post is free to move in the slot to a post-retainer portion of the slot and into the retention aperture formed in the body.

22. The assembly of claim 21, wherein the slot is keyhole-shaped and includes the entry and exit portion at one end thereof and the post-retainer portion at another end thereof.

23. A telescoping slide assembly comprising interconnected load-carrying, intermediate, and stationary slides movable relative to one another to extend and retract the load-carrying and intermediate slides relative to the stationary slide, the load-carrying slide being formed to include a slot, a post retainer coupled to the load-carrying slide and formed to include a retention aperture adapted to receive a mounting post coupled to a piece of equipment to be carried on the load-carrying slide and arranged to extend through the slot formed in the load-carrying slide, the post retainer being movable relative to the load-carrying slide between a slot-closing position adapted to retain at the same time the mounting post in the slot and the retention aperture and a slot-opening position adapted to release the mounting post from the slot and the retention aperture, and wherein the post retainer includes, in series, a base, a body formed to include the retention aperture, an actuator arranged to intercept a mounting post moving into an entry and exit portion of the slot, and a lift tab arranged to extend at an angle relative to the body.

24. The assembly of claim 18, further comprising a slide retainer coupled to the load-carrying slide to lie in spaced-apart relation to the post retainer and configured to engage a retraction stop included in the intermediate slide to block movement of the load-carrying slide relative to the intermediate slide from a fully extended position toward a retracted position within the intermediate slide.

25. The assembly of claim 24, wherein the slide retainer includes a base coupled to the load-carrying slide, a movable arm cantilevered to the base, and a button appended to a distal portion of the movable arm and arranged to extend into a button retention aperture formed in the intermediate slide and bordered by the retraction stop during movement of the load-carrying slide relative to the intermediate slide.

26. A telescoping slide assembly comprising interconnected load-carrying, intermediate, and stationary slides movable relative to one another to extend and retract the load-carrying and intermediate slides, a generally flat wall of the load-carrying slide being formed to include forward and rearward slots, each slot being adapted to receive a mounting post coupled to a piece of equipment to be carried on the load-carrying slide, at least one of said slots being formed to permit the post only to enter the slot by moving generally perpendicular to the plane of the generally flat wall, and a post retainer including a body formed to include a retention aperture and a base coupled to the post retainer and to the load-carrying slide, the body being arranged to move relative to the base from a slot-closing position blocking exit of a mounting post located in the rearward slot and in the retention aperture from the rearward slot to a slot-opening position allowing movement of a mounting post into and out of the rearward slot.

27. The assembly of claim 26, wherein the base is coupled to the load-carrying slide to cause the body to extend over at least a portion of the rearward slot and in a forward direction toward the forward slot.

28. The assembly of claim 26, further comprising a slide retainer coupled to the load-carrying slide to lie in spaced-apart relation to the post retainer and configured to engage a retraction stop included in the intermediate slide to block movement of the load-carrying slide relative to the intermediate slide from a fully extended position toward a retracted position within the intermediate slide.

29. The assembly of claim 28, wherein the slide retainer includes a base coupled to the load-carrying slide, a movable arm cantilevered to the base, and a button appended to a distal portion of the movable arm and arranged to extend into a button retention aperture formed in the intermediate slide and bordered by the retraction stop during movement of the load-carrying slide relative to the intermediate slide.

30. The assembly of claim 28, wherein the slide retainer includes a base, a movable arm cantilevered to the base, and a button appended to a distal portion of the movable arm, the base is coupled to the load-carrying slide to cause the movable arm to extend in a forward direction toward the rearward and forward slots and to position the button to extend into a button retention aperture formed in the intermediate slide and bordered by the retraction stop during movement of the load-carrying slide relative to the intermediate slide.

31. The assembly of claim 1, wherein the keyhole-shaped slot in the load-carrying slide is surrounded in a plane of the wall of the load-carrying slide.

* * * * *

UNITED STATES PATENT AND TRADEMARK OFFICE

CERTIFICATE OF CORRECTION

PATENT NO. : 7,604,307 B2
APPLICATION NO. : 10/692839
DATED : October 20, 2009
INVENTOR(S) : Greenwald et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1153 days.

Signed and Sealed this

Fifth Day of October, 2010

David J. Kappos

David J. Kappos
*Director of the United States Patent and Trademark Office*